US006934569B2

(12) United States Patent
Lancaster

(10) Patent No.: US 6,934,569 B2
(45) Date of Patent: Aug. 23, 2005

(54) ELLIPTICAL RESONATORS WITH RADIAL CURRENT MODE AND RADIO FREQUENCY FILTER FORMED THEREFROM

(76) Inventor: Michael John Lancaster, 12 Bramble Gardens, Worcester (GB), WR5 1SQ ( * ) Notice: Subject to any disclaimer, the term of this patent is extended or adjusted under 35 U.S.C. 154(b) by 2 days.

(21) Appl. No.: 10/221,700

(22) PCT Filed: Mar. 16, 2001

(86) PCT No.: PCT/GB01/01164

§ 371 (c)(1),
(2), (4) Date: Jan. 14, 2003

(87) PCT Pub. No.: WO01/69709

PCT Pub. Date: Sep. 20, 2001

(65) Prior Publication Data

US 2003/0151466 A1 Aug. 14, 2003

(51) Int. Cl.[7] ..... H01P 1/203; H01B 12/02

(52) U.S. Cl. ..... 505/210; 333/99 S; 333/204; 333/219; 505/700; 505/866

(58) Field of Search ..... 333/204, 219, 333/99 S; 505/210, 200, 701, 866

(56) References Cited

U.S. PATENT DOCUMENTS

| | | | | |
|---|---|---|---|---|
| 5,710,105 A | | 1/1998 | Shen | |
| 5,914,296 A | | 6/1999 | Shen | |
| 6,016,434 A | * | 1/2000 | Mizuno et al. | 333/99 S |
| 6,064,895 A | | 5/2000 | Baumfalk et al. | |
| 6,239,674 B1 | | 5/2001 | Enokihara et al. | |
| 6,252,475 B1 | * | 6/2001 | Enokihara et al. | 333/204 |

FOREIGN PATENT DOCUMENTS

EP 660438 A2 6/1995

* cited by examiner

*Primary Examiner*—Benny T. Lee
(74) *Attorney, Agent, or Firm*—Hogan & Hartson L.L.P.

(57) ABSTRACT

A resonator for use in a radio frequency filter including a substantially planar resonant portion that is substantially elliptical in plan. The resonant portion is mounted on a dielectric substrate. The resonator is configured to operate in at least a mode in which resonance occurs with a radial current and with substantially no current along the edge of the resonant portion. A filter comprising a plurality of the resonators is also disclosed.

14 Claims, 2 Drawing Sheets

ELLIPTICAL RESONATORS WITH RADIAL CURRENT MODE AND RADIO FREQUENCY FILTER FORMED THEREFROM

FIELD OF INVENTION

The present invention relates to resonators for use in radio frequency filters, and to a radio frequency filter utilizing such filters.

The invention has been developed primarily for use in microwave communications filters using superconducting resonators, and will be described hereinafter with reference to this application. However, it will be appreciated that the invention is not limited to use in this field.

BACKGROUND TO INVENTION

There are a number of geometrical structures made of conducting or dielectric materials that can perform the function of a microwave filter. Such resonators are often used as basic building blocks in bandpass filters for use in the telecommunications field.

A commonly used type of resonator in such situations is the microstrip resonator, which, as its name implies, takes the form of an elongated strip. The strip is supported by a dielectric substrate, which has a ground-plane mounted on its backside.

One difficulty with existing microstrip resonators is that, in use, the current is not evenly distributed within the cross-sectional area of the resonator. In particular, such resonators tend to have peak currents at the edge of cross-sectional boundaries. While careful design and optimization can prevent this from becoming a problem, it also means that the resultant resonator is a relatively large structure.

The problem is exacerbated where superconducting materials are used because the performance of superconducting materials degrades once a critical current is exceeded, which can occur because of the high edge currents. This means that, again, the resonant component must be made relatively large.

Some of these problems can be ameliorated by using a circular resonator. However, altering the diameter of such resonators to change the frequency response causes the frequency of all the resonant modes of the resonator to change proportionally.

SUMMARY OF THE INVENTION

According to a first aspect of the invention, there is provided a resonator for use In a radio frequency filter, the resonator including a substantially planar resonant portion, the resonant portion being substantially elliptical in shape and mounted on a dielectric substrate, the resonator being configured to operate in one or mare modes in which resonance occurs with a radial current and with no current along the edge of the resonant portion.

Preferably, the resonator further includes a ground-plane mounted on the dielectric substrate on a side thereof opposite to the resonant portion.

Preferably, the resonant portion is formed from a superconducting material.

In one form, the resonator further includes an aperture formed in the resonant portion. Preferably in this case, the aperture is elliptical.

According to a second aspect of the invention, there is provided a radio frequency filter comprising a plurality of resonators according to the first aspect, the resonators being positioned relative to each other such that each resonator is operatively coupled to at least one other resonator, wherein at least one of the resonators is configured to receive a radio frequency input signal and at least one other resonator is coupled to an output, such that the signal present at the output is a filtered version of a signal received at the input.

Preferably, at least some of the resonators are disposed in substantially the same plane as each other. In a preferred form, the resonators in substantially the same plane as each other share a common dielectric substrate and/or ground-plane.

In a preferred embodiment, at least first and second resonators are displaced relative to each other in a direction normal to the planes of the resonant portions thereof. Preferably, the resonant portion of the first resonator partially overlaps the resonant portion of the second resonator.

BRIEF DESCRIPTION OF DRAWINGS

Preferred embodiments of the invention will now be described, by way of example only, with reference to the accompanying drawings, in which.

DETAILED DESCRIPTION OF PREFERRED EMBODIMENTS

Figure 1:
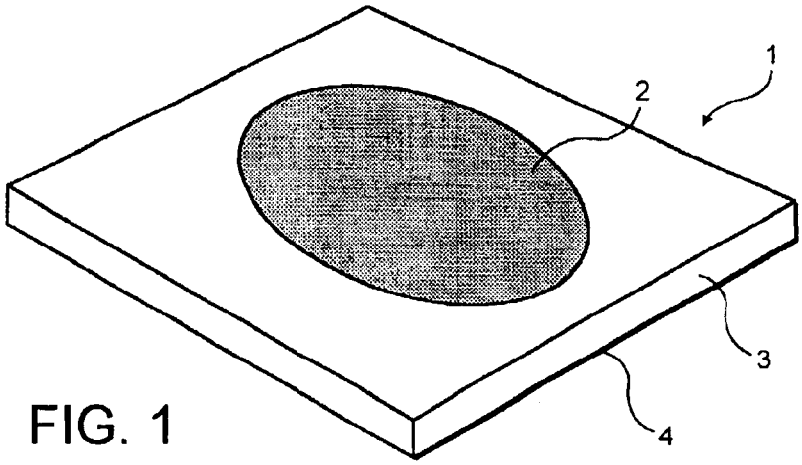
FIG. 1 is a perspective view of a resonator for use in a radio frequency filter, in accordance with the invention.

Referring to the drawings, and FIG. 1 in particular, a resonator 1 includes a substantially planar resonant portion 2. The resonant portion 2 is substantially elliptical in plan and mounted on a dielectric substrate 3. In the preferred embodiment shown, a groundplane 4 is also provided, mounted to the opposite side of the dielectric substrate 3.

Figure 2:
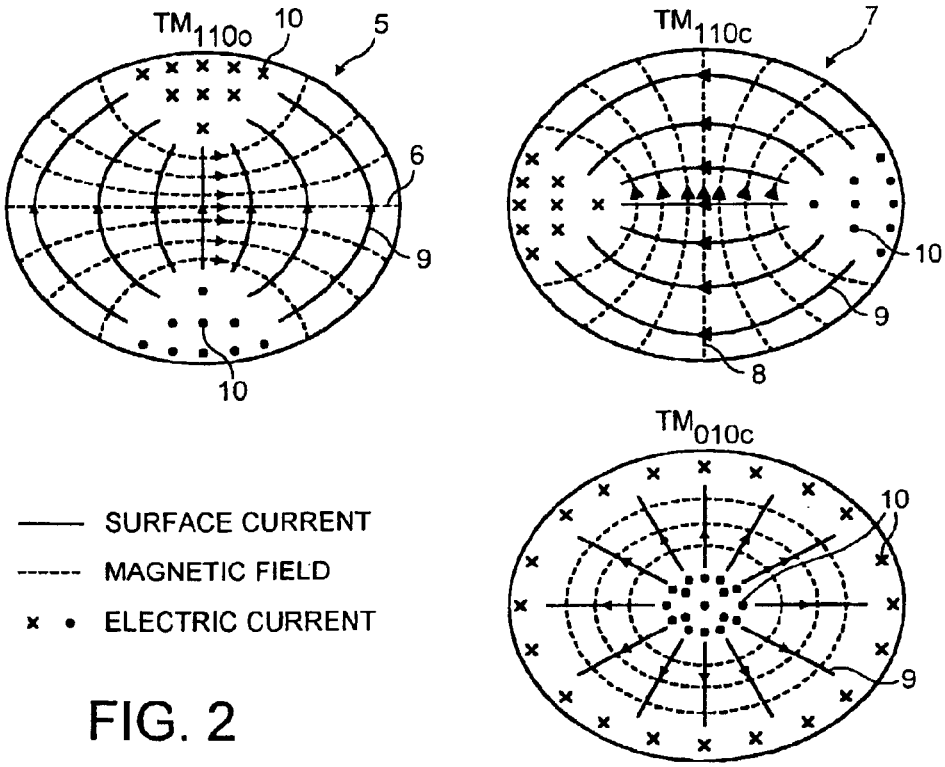
FIG. 2 is a plot of three available resonant modes for the resonator of FIG. 1, two of which are modes used conventionally (i.e., $TM_{110o}$, and $TM_{110c}$ and the third of which is an example of a mode in which the resonator of the present is configured to operate (i.e., $TM_{010c}$)

Turning to FIG. 2 in which, consistent with the knowledge of those of skill in the art to which the present invention pertains, solid lines generally represent surface current, dashed lines generally represent magnetic field and x's and dots represent non-surface electric current, the resonator 1 of FIG. 1 would conventionally be configured to operate in a first mode 5, in which resonance occurs at a first radio frequency along a major axis 6 of the resonant portion 2 of FIG. 1, and/or in a second mode 7, in which resonance occurs at a second radio frequency along a minor axis 8 of the resonant portion 2 of FIG. 1. Because of their different physical lengths, the first and second radio frequencies will be different to each other.

It will be noted that the field patterns of the magnetic and electric fields are the same except for a 90-degree rotation relative to each other, with the ellipticity of the resonator altering the frequency separation of these two modes. However both these modes have edge currents, which are undesirable when used with superconducting materials.

In FIG. 2, the third mode depicted has no peaked edge currents, and is an example of a mode in which the resonator of the present invention is configured to operate. The absence of edge currents is important for two reasons. Firstly as current increases it becomes close to the critical current of the superconductor. As the critical current is approached the performance of the resonator reduces, and if the critical current is exceeded the superconductor behaves like a normal conductor. Secondly there are likely to be defects in the edges due to the patterning process, and if current tries to flow through the defects again problems with performance may result. By reducing or eliminating edge currents these problems can be ameliorated or avoided. The frequency of the radial mode is determined by the size of the resonator and can be altered by changing the dimensions of the major and minor axis.

The resonances are caused by applying an electrical or magnetic signal to the resonator 1, which in turn generates associated surface currents 9 and electrical fields 10. The electrical signal can be applied in any of a number of ways, such as direct conduction, electric capacitance or magnetic induction.

In one form, the resonant portion 2 and ground-plane 4 are formed from a conductor such as copper. However, in a particularly preferred form, the resonant portion and/or the ground plane is formed from a superconducting material or a combination of a superconducting material and a conductor such as gold, silver or copper. The preferred superconducting materials, such as High Temperature Superconductors for example, but not exclusively, $YBa_2Cu_3O_{7-6}$ or $Tl_2Ba_2CaCuO_8$, or conventional superconductors such as but not exclusively Niobium can be used.

In the case of thin film High Temperature Superconductor devices, the preferred dielectric materials are compatible single-crystalline substrates like $LaAlO_3$, MgO or sapphire with a buffer layer.

The specific materials used are not critical, and will vary depending upon the bandwidth of the resonator and current carrying capacity required for any given situation.

The current distribution in the elliptical resonator is preferable to that of an equivalent value strip resonator (for a given resonant mode), in that relative peak values are not at the edge. This means that the elliptical resonator can have a higher current carrying capacity without a reduction in performance. Reduction in performance means an unwanted increase in the bandwidth or reduction in the quality factor of the resonator.

Figure 3:
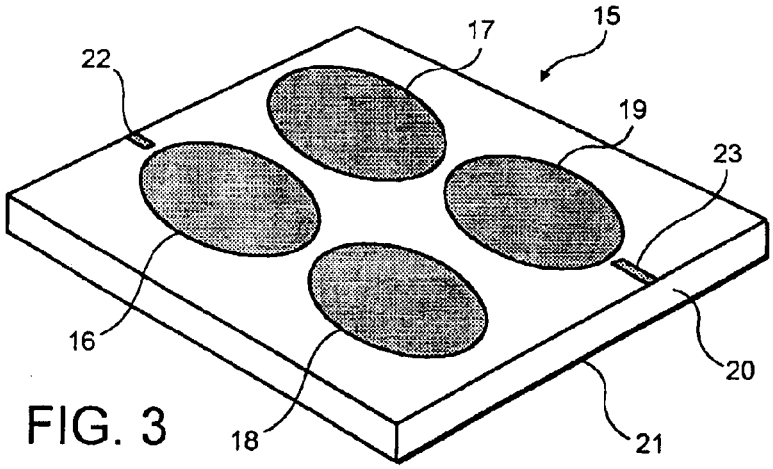
FIG. 3 is a perspective view of a filter comprising a plurality of elliptical resonant portions, in accordance with the invention.

The resonator 1 can be used in filters for telecommunications and other applications. An example is shown in FIG. 3, in which a filter 15 is shown comprising four resonators 16, 17, 18 and 19. The resonators 16, 17, 18 and 19 share a common dielectric substrate 20 and ground-plane 21. An input tab 22 and an output tab 23 are also mounted to the substrate 20.

An input signal is applied to the input tab 22, which is capacitively coupled to the first resonator 16. Assuming the input signal includes a suitable frequency component, the first resonator resonates, which in turn causes resonances in the second and third resonators 17 and 18 also via capacitive coupling. The electrical fields generated as a result of this coupling are in turn capacitively coupled to the fourth resonator 19, which is capacitively coupled to the output tab. The result is a frequency-filtered version of the input signal.

In other embodiments, the input tab can be conductively or inductively coupled to the first resonator.

Figure 4:
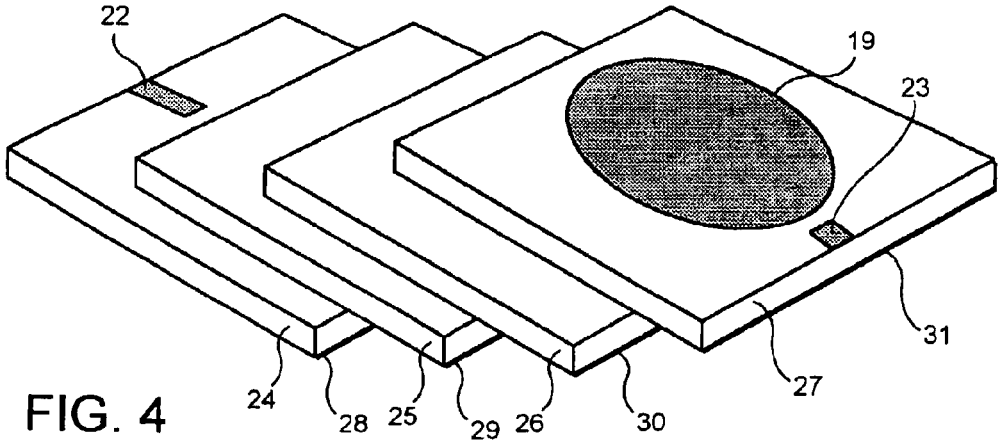
FIG. 4 is a perspective view of an alternative embodiment filter comprising a plurality of elliptical resonant portions, also in accordance with the invention.

An alternative embodiment filter is shown in FIG. 4, in which like components are designated with like numerals. In this case, separate dielectric substrates 24, 25, 26 and 27 are used to mount each of the first; second, third and fourth resonators of which only resonator 19 is shown, and corresponding ground-planes 28, 29, 30 and 31 are also provided. The resonators are positioned in a stacked, partially overlapping configuration. The relative positions of the resonators and the extent of their overlap changes the response of the filter. Coupling in this embodiment is in the vertical as well as horizontal planes.

In both filter examples, modeling the individual elements in a suitable computer software package, and then optimizing through testing can determine appropriate values for sizes and spacing between the various components. It will be appreciated that the complexity of the interaction between the various components means that modeling alone may not provide the required filter response. However, the testing involved is of a routine nature and well within the capacity of those skilled in the art.

It will also be appreciated that the coupling between elements can be conductive (using conductive strips or bridges), capacitive or inductive, depending upon the desired behaviour.

A particular advantage of the elliptical resonator when used in filters such as those described is its improved response to spurious signals. For example, the out of band rejection is superior to that of a microstrip resonator or circular resonator having a similar frequency response and power handling capability.

It will be appreciated that altering the relative lengths of the major and minor axes will alter the ratio of resonant frequency modes along those axes. It will also be understood that while a perfect ellipse is desirable, any substantially elliptical or oval shape will also provide much of the advantages of a perfect ellipse.

Although the invention has been described with reference to a number of specific examples, it will be appreciated by those skilled in the art that the invention can be embodied in many other forms.

What is claimed is:

1. A resonator for use in a radio frequency filter, the resonator including a substantially planar resonant portion, the resonant portion being substantially elliptical in shape and mounted on a dielectric substrate, the resonator being configured to operate in a mode in which resonance occurs with a radial surface current and with substantially no current flowing along the edge of the resonant portion.

2. A resonator according to claim 1, further including a ground-plane mounted on the dielectric substrate on a side thereof opposite to the resonant portion.

3. A resonator according to claim 1, wherein the resonant portion comprises a superconducting material.

4. A resonator for use in a radio frequency filter, comprising:

substantially planar resonant portion having a center and an edge, the resonant portion being substantially elliptical in shape and being mounted on a dielectric substrate;

wherein the resonator is configured to operate in a mode in which resonance occurs with surface current flowing substantially only in a direction from the center of the resonant portion to the edge of the resonant portion and with substantially no current along the edge of the resonant portion.

5. The resonator of claim 4, wherein the resonator is configured to operated in at least a TM0n0 mode.

6. The resonator of claim 5, wherein the resonator is configured to operate in at least a TM010 mode.

7. A radio frequency filter comprising a plurality of resonators, each of the resonators including a substantially planar resonant portion, mounted on at least one dielectric substrate, with a substantially elliptical shape, the plurality of resonators being positioned relative to each other such that each resonator is operatively coupled to at least one other resonator, wherein at least one of the resonators is configured to receive a radio frequency input signal and at least one other resonator is coupled to an output, such that the signal present at the output is a filtered version of a signal received at the input, and wherein each of the resonators is configured to operate in a radial mode in which resonance occurs with a radial surface current and with substantially no current flowing along an edge of the planar resonant portion.

8. A radio frequency filter according to claim 7, wherein at least some of the plurality of resonators are disposed in a substantially common plane.

9. A radio frequency filter according to claim 8, wherein the resonators disposed in the substantially common plane share a common dielectric substrate and/or ground-plane.

10. A radio frequency filter comprising:

a plurality of resonators comprising substantially planar resonant portions having a substantially elliptical shape mounted on separate dielectric substrates, whereby the planar resonant portions are displaced relative to adjacent ones of the planar resonant portions in a direction normal to planes of the resonant portions;

wherein the plurality of resonators are positioned relative to each other such that each resonator is operatively coupled to at least one other of the resonators;

wherein at least one of the resonators is configured to receive a radio frequency input signal and at least one other of the resonators is coupled to an output, such that a signal present at the output is a filtered version of the received frequency input signal received at the input; and wherein each of the resonators is configured to operate in a mode in which resonance occurs with a radial surface current and with substantially no current flowing along an edge of the resonant portion.

11. A radio frequency filter according to claim 10, wherein the resonant portions comprise a superconducting material.

12. A radio frequency filter according to claim 10, wherein the resonant portion of a first of the plurality of resonators partially overlaps the resonant portion of a second of the plurality of resonators.

13. A radio frequency filter according to claim 12, wherein the operative coupling between adjacent ones of the resonators is vertical and horizontal relative to the planar resonant portions of adjacent ones of the resonators.

14. A radio frequency filter according to claim 13, wherein the operative coupling is conductive, capacitive, or inductive.

* * * * *